United States Patent [19]

Arnold

[11] 4,274,580

[45] Jun. 23, 1981

[54] CONTAINER CARRIER

[75] Inventor: Clayton R. Arnold, Bolingbrook, Ill.

[73] Assignee: Alton Box Board Company, Alton, Ill.

[21] Appl. No.: 66,240

[22] Filed: Aug. 13, 1979

[51] Int. Cl.[3] ..... B65D 5/02; B65D 5/46; B65D 5/54; B65D 75/00

[52] U.S. Cl. ..... 229/52 B; 206/155; 206/427; 206/614

[58] Field of Search ..... 206/427, 141, 155, 158, 206/614, 162, 167; 229/52 B, 40

[56] References Cited

U.S. PATENT DOCUMENTS

| | | | |
|---|---|---|---|
| Re. 29,063 | 12/1976 | Graser | 206/141 |
| 2,842,304 | 7/1958 | Ringler | 229/52 B |
| 3,094,268 | 6/1963 | Swanson et al. | 229/52 B |
| 3,176,902 | 4/1965 | Champlin | 206/158 |
| 3,186,545 | 6/1965 | Conrades | 206/155 |

*Primary Examiner*—William T. Dixson, Jr.

*Attorney, Agent, or Firm*—Paul M. Denk

[57] ABSTRACT

In a container carrier for use in the conveyance of a plurality of beverage laden containers, the carriers formed of a pair of end walls connected with a bottom wall, a top structure for the carrier, and a pair of side walls connecting to either side of the carrier to provide it with significant closure; each side wall being formed of a pair of panels, the first comprising a bottom panel, while the second forms an upper panel that adheres along its lower edge with the first panel. A tear strip is provided along the length within each second panel, and when removed, provides for a pivoting upwardly of at least the upper portion of the second panel for removal of the beverage containers. In addition, a pair of lines of perforation or scores are formed in the top structure of the carrier, and when torn free, form a handle grip, reinforced through the addition of tape, that allows for carrying during the return of the beverage containers back to the source of purchase.

7 Claims, 7 Drawing Figures

CONTAINER CARRIER

CROSS-REFERENCE TO RELATED PATENTS

The subject matter of this invention is related to improvements upon the returnable wrap-around carrier shown in U.S. Pat. Nos. 3,090,520 and 3,119,546, each owned by a common assignee.

BACKGROUND OF THE INVENTION

This invention relates generally to a carrier, and more specifically pertains to a side loading container carrier which incorporates easy opening features that do not detract from the structural strength, and at the same time, provides reinforcement to facilitate its carrage upon return of its empty containers.

Back in the early 1960's the U.S. patent to Wuerthner, U.S. Pat. No. 3,090,520, issued disclosing a container carrier, of the side loading type, meaning that the various bottom, top, and interconnected end walls would form a tubular wrap upon their connection together, leaving the sides opened, and wherein the beverage containers may be loaded before the side walls were folded into closure. The advantage of such a container carrier are manyfold, but principally its benefits provide for the foldable connection of the outer shell of the container blank as it moves along the carton folding machinery, and thereby easing the carton loading step by providing clear access to its opened sides and into which three or more of the beverage containers could be easily inserted. Hence, the uniqueness of the invention at that time was to allow for both the folding of the container and its loading almost simultaneously upon the same machinery. Further improvements upon the identified container carrier are also shown in the second patent to Weurthner, U.S. Pat. No. 3,119,546.

Various other containers of this or a related type have likewise been patented during the ensuing years, and such can be seen from U.S. the patent to Wood, U.S. Pat. No. 3,640,448; the U.S. patent to Champlin, U.S. Pat. No. 3,356,283; and another patent to Champlin, U.S. Pat. No. 3,176,902, in addition to the patent to Mahon, U.S. Pat. No. 3,152,688. Furthermore, the U.S. patent to Weiss, U.S. Pat. No. 3,163,322, discloses a carrier for aluminum cans, while other model carriers of various designs are shown in the U.S. patent to Wysocki, U.S. Pat. No. 3,156,377; Wood, U.S. Pat. No. 3,540,582; and the U.S. patent to Mahon, U.S. Pat. No. 3,167,214.

Various modifications have been made to the wrap around type of carrier, and such is shown in the U.S. patent to Grayser, U.S. Pat. No. Re. 29,063, wherein an easy opening tear feature is provided that facilitates the removal of the beverage containers, usually beer, from the carrier. While apparently the easy open feature as shown in this U.S. prior art patent is advantageous for attaining that end result, it does minimize the strength of the carrier when it is intended to also be supplementally used for container return purposes. Thus, the current invention is intended to yet adapt the quick opening feature as sought for in some of the prior art disclosed above, but at the same time, retains the interstructutral relationship between the various panels of the carrier that yet assure sufficient reinforcement in the top structure of the carrier, as when beverage containers are being removed, but being further adaptable for modification of its top structure so as to facilitate the reentry and return of the empty containers back to the market.

It is, therefore, the principal object of this invention to provide a wrap around or side loading container carrier that is sufficiently reinforced in its upper structure so as to be significantly strengthened during usage by the customer.

Another object of this invention is to provide a quickly attainable handle means from the top structure of a container carrier to facilitate the return of the empty containers back to the market.

Another object of this invention is to provide for a reinforced carrying means in the upper segment of a beverage carrier.

Still another object of this invention is to provide an easy open tear feature provided to either side of a beverage container carrier that facilitates removal of such containers, without diminishing its structural strength.

Still another object of this invention is to provide means for reinforcing a returnable container carrier.

Other objects will become more apparent to those skilled in the art upon reviewing the summary of this invention, and upon undertaking a study of the description of its preferred embodiment in view of the drawings.

SUMMARY OF THE INVENTION

This invention contemplates the formation of a container carrier, having the usual bottom, top, and end walls, and preferrably of the type generally identified as the wrap around type of carrier, that facilitates the side loading of the beverage containers therein. On the other hand, the various improvements to the container carrier as disclosed in this invention may be adaptable for usage in other types of carriers, regardless whether they may be of the side loading type, or otherwise.

The carrier is formed having a bottom wall joining with end wall panels, and a top structure, to form a tubular enclosure, and after the beverage containers are loaded therein, side walls are folded into closure. Each side wall is formed of a pair of panels, a first or bottom panel that secures to both of the proximate end edges of the end walls, while initially being hingedly connected also with the bottom wall. The second or upper panel of the side walls are hinged along the length of the top structure, and then bent downwardly along an incline for connection also with the upper edge of the first side wall panel. Then single or double tear strips are provided along the length of the second panels, and when removed, provide for the pivoting upwardly of that portion of the second panel arranged thereabove, such pivoting occurring along their line of hinged connection with the carrier top structure. When maneuvered into this position, the beverage containers may be easily removed from the now opened carrier. But, when all of the beverage of the various containers have been consumed, and it is desirable to return the containers either back to the market, or simply to convey them to a point of disposal, a handle is formed along the length of the carrier top structure so as to facilitate its conveyance. Frequently, where the entire top of the carrier is torn open, such as shown in the prior U.S. Pat. No. Re 29,063, supra, there is a tendency for the side walls, particularly at their end edges, to tear free as the carrier is being hand held from underneath for conveyance. Thus, to alleviate that deficiency, the handle arranged along the length of the top structure of the subject carrier is formed through the agency of a pair of lines of perforations running approximately the length of the said top structure, having the width of the spacing between the lines of perforations forming the said handle, with the remaining portions of the top structure outside of the perforated lines and that upper portion of the second panels of the side walls capable of being torn away and removed, thereby exposing just that narrow handle in the upper segment of the carrier that can be easily grasped after the emptied beverage containers are reinserted therein. To further add to the reinforcement of the carrier in the vicinity of its identified upper formed handle, a reinforcing tape is adhered to the inner surface of the handle, along its length, with the same tape, at its ends, bending for adhesion against the upper portion of the end walls of the formed carrier.

DESCRIPTION OF THE PREFERRED EMBODIMENT

Figure 1:
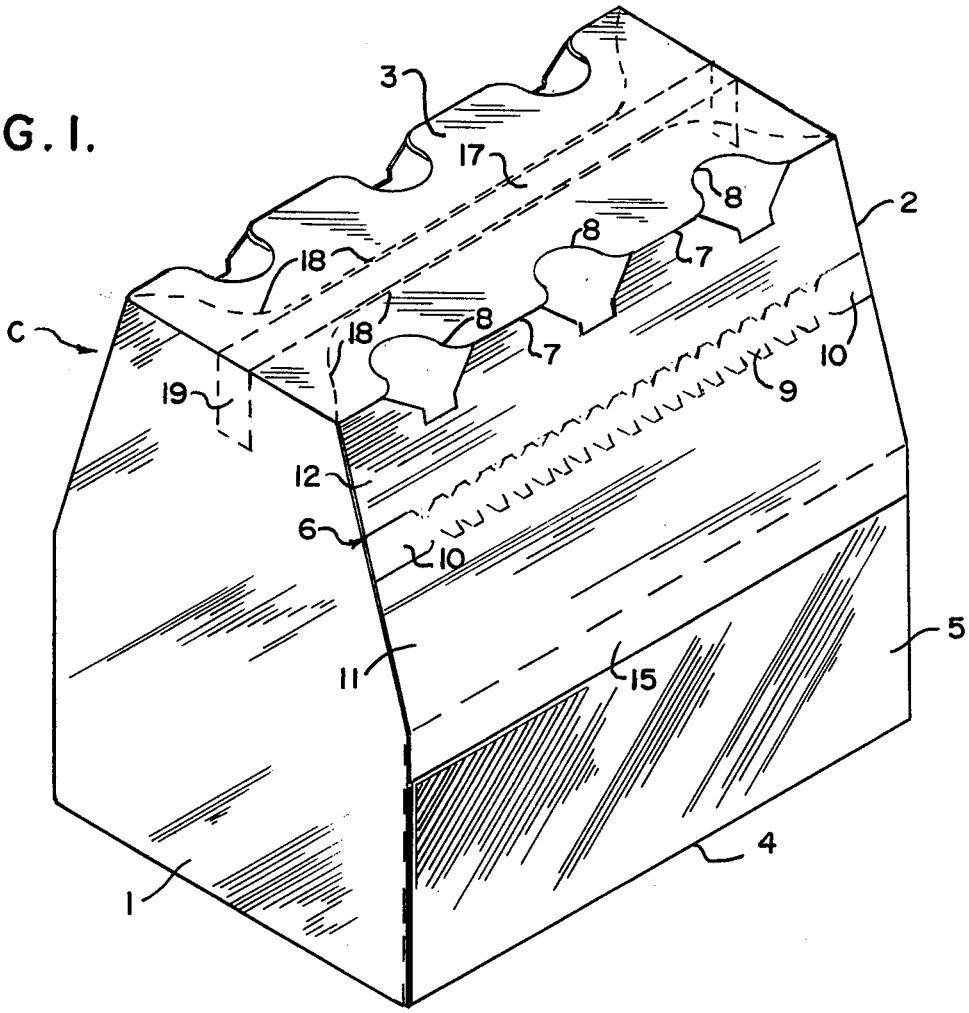
FIG. 1 discloses an isometric view of the improved container carrier of this invention.

In referring to the drawings, and in particular FIG. 1, there is disclosed the container carrier C of this invention, formed in the usual style having a pair of end wall panels 1 and 2, a carrier top structure 3, and a bottom wall 4 forming the underneath of the carrier. These four components, when foldably connected together and secured into their rectangular form, will provide a tubular enclosure that is capable of accepting the insertion of beverage containers, such as bottles of beer, or the like, therein, and thus living up to its descriptive attributes of comprising a side loading carrier.

In the further fabrication of the carrier, it incorporates side walls, to either side, with each side wall being formed of a pair of panels, that being a bottom panel 5 and an upper panel 6. The bottom panel 5 is hinged connected with the bottom wall 4, folded upwardly therefrom, and is secured with the lower segment of end walls 1 and 2 in a manner as will be subsequently described. In addition, the upper or second panel 6 is hingedly connected along the length of the carrier to its top structure 3, as along the hinge line 7, with openings being provided along the said hinge line, as at 8, for accommodating the extension of at least the cap of the contained bottle therethrough.

Figure 7:
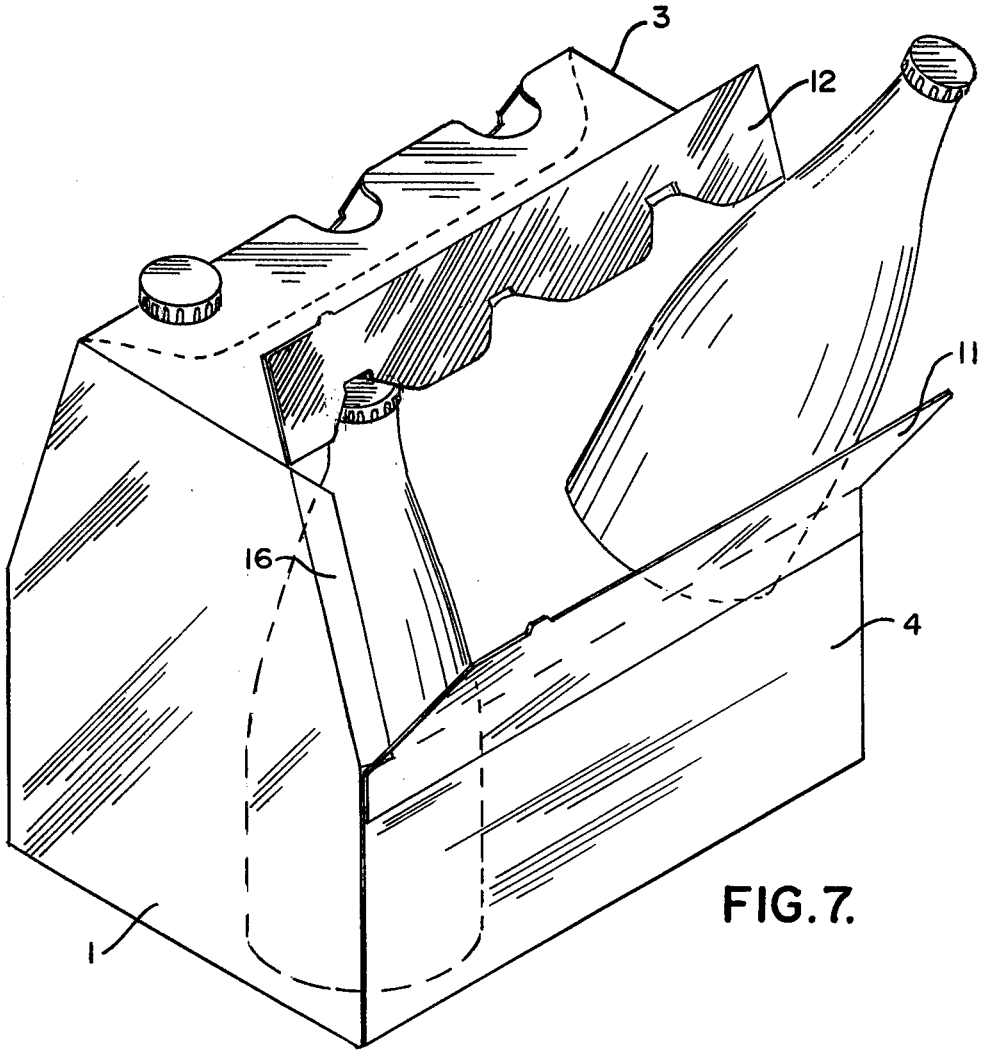
FIG. 7 discloses an isometric view of an opened carrier, wherein its tear strip has been removed, providing for a pivoting of the various parts of its second panel to facilitate the removal or reinsertion of the beverage containers.
Figure 6:
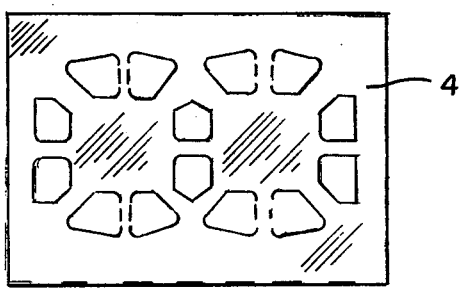
FIG. 6 provides a bottom view of the container carrier shown in FIG. 1.

Each of the upper or second panels 6 are formed having a tear strip 9 furnished along its length, with the tear strip shown in FIG. 1 comprising what is defined as a double pull type tear strip meaning that it may be torn loose from the panel by initiating its pull from either of its tab ends 10. When the tear strip 9 is removed, the second panel itself is formed into two segments, that comprising a lower segment 11 and an upper segment or flap 12. The lower segment 11 may or may not be adhered with the end walls 1 and 2, in a manner that will be subsequently defined. But, the upper segment 12 of each second panel 6, when the tear strip is removed, is free to pivot upwardly, as along its hinge line 7, and thereby provide clearance for the slight lateral movement of the carrier enclosed beverage containers, such as the bottles as shown in FIG. 7, so that they may be elevated and removed from the carrier for consumption.

Figure 2:
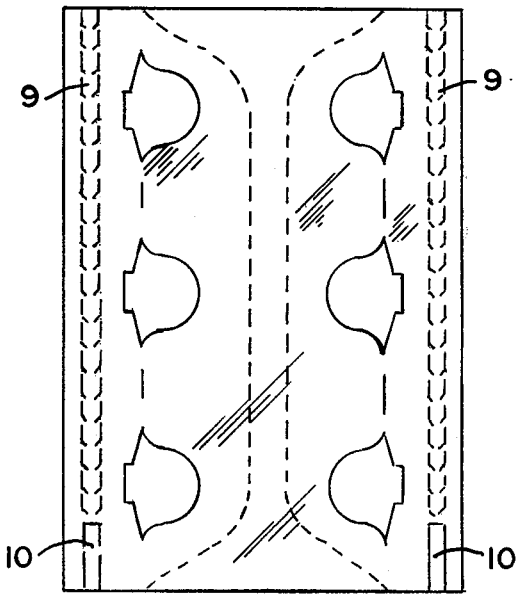
FIG. 2 provides a top view of the container carrier of FIG. 1, also showing a pair of single pull tear strips provided in each side wall of the same.
Figure 3:
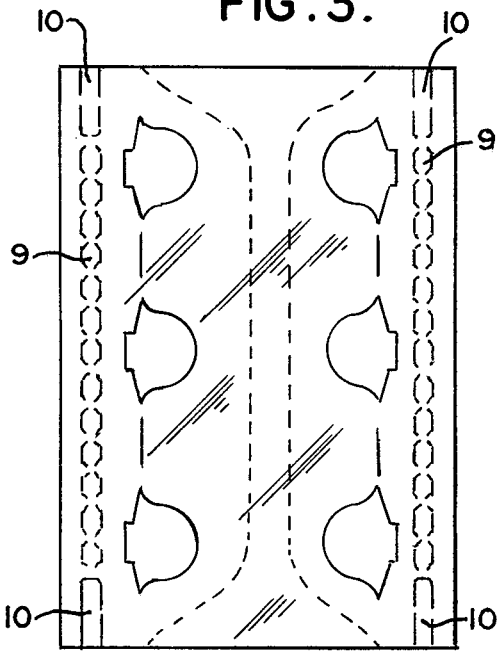
FIG. 3 provides a top view of the container carrier shown in FIG. 1, and further disclosing a pair of double pull tear strips, one each being formed in a side wall of the same.
Figure 4:
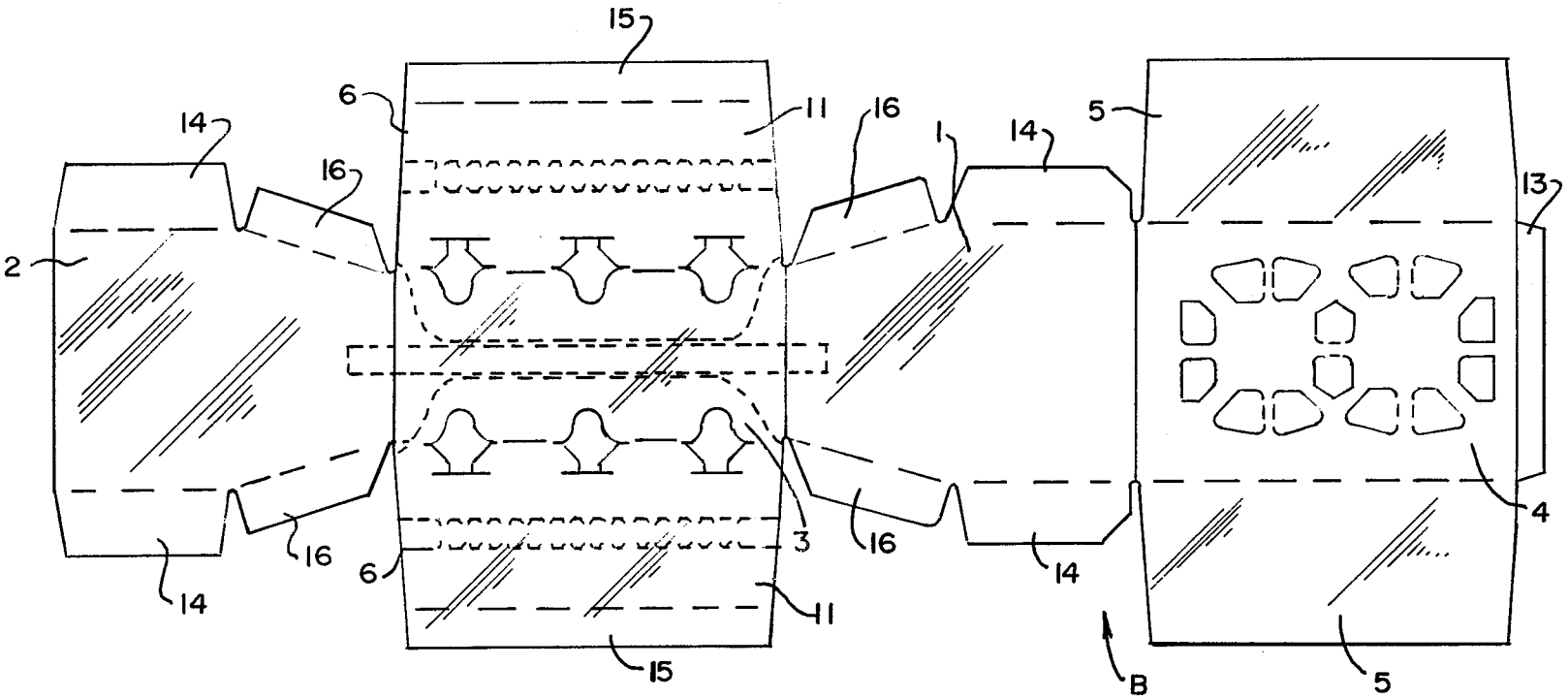
FIG. 4 provides a plan view of the blank for forming the container carrier of this invention.
Figure 5:
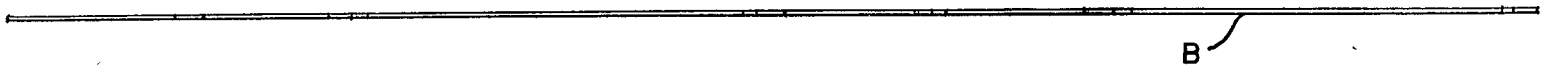
FIG. 5 provides a longitudinal edge view of the blank shown in FIG. 4.

As can be seen in FIGS. 2 and 3, the tear strips 9 provided to either side of the carrier may be of the single pull type, having their pull tab 10 located just at one end, as specifically shown in FIG. 2, or in the alternative, and more preferrably, the tear strips 9 may be of the double pull variety, having their pull tabs 10 formed at either end to add to the convenience of the user for prompt removal of a tear strip when dispensing the beverage bottles contained therein. In any event, regardless which style of tear strip may be embodied within the carrier, it is significant to note that when the upper segments 12 are free to pivot upwardly to provide clearance for the removal of the beverage containers, the top structure 3 of the carrier remains intact, with its integrally hinged connection with the end walls 1 and 2 remaining secure, and thereby sustaining this structural reinforcement for the top area of the carrier, and consequently preventing any buckling of its bottom portion in the event that one should hold the entire container carrier from underneath.

As previously analyzed, it was stated that the top structure 3, bottom wall 4, and end walls 1 and 2 are secured together into the tubular form, and this is achieved by adhering, usually by means of gluing, of the bottom of the end wall 2 with the flange 13 provided to one end of the bottom wall 4. In addition, the bottom panels 5 are disposed for connection with the lower flanges 14 extending integrally from the lower sections of the end walls 1 and 2, and are permanently adhered therewith also by means of an adhesive. Furthermore, and as previously explained, each lower edge 15 of the bottom segment 11 of the second panel 6 is disposed for adhesive adherence with the upper edges of the first or lower panels 5 provided to either side of the carrier. This can clearly be seen in FIG. 1. Also, and as previously alluded to, the lower segment 11 of the first panel 6 of each side wall may also be adhered by means of a glue or other fastener with the upper flanges 16 integrally extending from the upward edges of end walls 1 and 2. Thus, when the tear strip 9 is removed from one or both sides of the carrier, as shown in FIG. 1, this allows for the upward pivoting of the upper segment 12 of the upper panel 6, since it usually will not be adhered with the flanges 16, and if the lower segment 11 of the second panel 6 has not been adhered with the same flanges 16, it may be pivoted downwardly for providing total clearance for removal of any beverage container from within the carrier. This can also be clearly seen in FIG. 7. In the alternative, and in the preferred embodiment, it is usually desired to sustain the lower segment 11 of the panel with the flange 16 by means of some form of adhesive, such as by a carton glue, thereby maintaining that segment intact, with sufficient clearance yet being provided through the upward pivoting of the upper segment 12 of the panel 6, for removal of the beverage containers, as can clearly be seen from FIG. 7.

Means are further provided in the construction of this container carrier that adds to the convenience of its usage, particularly for container return purposes, and in addition, adds to the reinforcement of the carrier in its upper region. For example, and as can be seen from the various drawings, a formable handle 17 is provided between the two lines of perforations or scores, as at 18, so that when all of the beverage containers have been removed and dispensed from the carrier, or even to aid in the prompt removal of the same from the carrier, the upper segment 12 of each panel 6 may be torn free from the carrier, along the score lines 18, thereby providing only the integral handle 17 spanning the length dimension between the end walls 1 and 2 of the carrier. And, this handle 17 is reinforced by the application of a tape 19 to its underside, and which tape further extends slightly downwardly along the end wall 1 and 2, to thereby insure the maintenance of a handle within the carrier, and to prevent its tearing free from the same. In any event, once these upper segments 12 are removed from either side of the carrier, empty bottles or containers may easily be slid back into the same, and the carrier may be conveyed through a grasping of its handle 17 to a point where it may be disposed, if returnable bottles are not used, or the same may be carried back to the market, for a return of the deposit funds. Certain jurisdictions now require that all empty beverage containers be of the returnable type, that a deposit be demanded upon purchase, and that a certain portion of the deposit be refunded upon the mandatory return of the empty bottle.

Numerous variations in the design of the essential elements of this invention as disclosed in the drawings, and as herein described, may occur to those skilled in the art upon reviewing the subject matter of this invention. Such variations if within the spirit of this invention, are intended to be encompassed by the scope of any claims to patent protection issuing hereon. The description of the preferred embodiment set forth herein is provided merely for illustrative purposes only.

Having thus described the invention what is claimed and desired to be secured by Letters Patent is:

1. In a side loading container carrier having a rectangular bottom wall, a pair of end walls connectible with said bottom wall, and a carrier top structure foldably secured to the end wall panels to form a tubular structure that facilitates its side loading, side walls connectible to either side of the carrier to provide closure at both sides of the tubular formed structure, adhesive means securing said side walls to the end wall panels, each side wall formed having a pair of panels, said first panel comprising a bottom panel and being secured at both its end edges with the end walls, the second panel being hinged along its length with the top structure and arranged along an incline for connection with the upper edge of the first panel, and a tear strip provided along the length of each second panel of the side walls and when removed providing an upper flap allowing its pivoting upwardly with respect to the permanent top structure for removal of containers from the carrier, and integral flanges for foldably connecting along the sides of each end wall, and the first panel and that portion of the second panel below the tear strip being permanently affixed to the proximate end wall flanges.

2. The invention of claim 1 and wherein the tear strip comprises a single pull tear strip.

3. The invention of claim 1 and wherein the tear strip comprises a double pull tear strip.

4. The invention of claim 1 and including an integral handle provided in the carrier top structure, lines of perforations formed to either side of the formed handle, and tear out sections formed outwardly of the perforations for removal of the remaining portions of the top structure and that portion of the second panel hinged thereto and provided above the tear strips.

5. The invention of claim 4 and including reinforcing means provided along the formed handle to reinforce it during usage and to prevent its tearing.

6. The invention of claim 5 and including said reinforcing means comprising a tape adhering to the inner surface of the handle and extending partially down the proximate end walls.

7. The invention of claim 1 and wherein that portion of said second panel below the tear strip capable of separating from the approximate end wall flanges.

* * * * *